United States Patent [19]

Brokaw

[11] Patent Number: 4,855,618

[45] Date of Patent: Aug. 8, 1989

[54] MOS CURRENT MIRROR WITH HIGH OUTPUT IMPEDANCE AND COMPLIANCE

[75] Inventor: A. Paul Brokaw, Burlington, Mass.

[73] Assignee: Analog Devices, Inc., Norwood, Mass.

[21] Appl. No.: 156,189

[22] Filed: Feb. 16, 1988

[51] Int. Cl.[4] ..... G05F 1/56

[52] U.S. Cl. ..... 307/296.6; 307/310; 323/315; 330/288

[58] Field of Search ..... 307/296 R, 297, 310; 323/315–316; 330/288

[56] References Cited

U.S. PATENT DOCUMENTS

| | | | |
|---|---|---|---|
| 4,399,375 | 8/1983 | Sempel | 323/315 X |
| 4,471,292 | 9/1984 | Schenck et al. | 323/315 |
| 4,618,816 | 10/1986 | Monticelli | 307/297 X |
| 4,629,973 | 12/1986 | Voorman | 323/316 |
| 4,642,551 | 2/1987 | Miller | 323/314 |
| 4,645,948 | 2/1987 | Morris et al. | 307/310 X |
| 4,697,154 | 9/1987 | Kousaka et al. | 330/288 X |

*Primary Examiner*—David Hudspeth

*Attorney, Agent, or Firm*—Wolf, Greenfield & Sacks

[57] ABSTRACT

A circuit which employs a pair of MOS transistors operating at equal gate and sources voltages, and nearly equal drain voltages, to produce an accurately ratioed current mirror. The gate voltage of the transistor pair is controlled by a simple current mirror operating at a small fraction of the total output. The latter current mirror also functions as a wideband negative impedance converter. A comparable bipolar circuit is also discussed.

11 Claims, 1 Drawing Sheet

MOS CURRENT MIRROR WITH HIGH OUTPUT IMPEDANCE AND COMPLIANCE

FIELD OF THE INVENTION

This invention relates to circuits of a type called "current mirrors", which are widely used in electronic equipment. More particularly, the invention is an improved current mirror circuit having both high output impedance and high compliance (i.e., dynamic range of output voltage relative to power supply voltage).

BACKGROUND OF THE INVENTION

Current mirrors and their uses are well known. One representative text which discusses some of the conventional prior art relative to current mirrors is P. Horowitz and W. Hill, *The Art of Electronics,* Cambridge University Press, Cambridge, England (1980) at 71–74, which is hereby incorporated by reference. The simplest, or basic, current mirror is a two-transistor (bipolar or MOS) circuit, such as the example of FIG. 1. Although basic current mirrors of this type are useful in many situations, their output impedance is relatively low; this characteristic renders the simple current mirror unsuitable in many applications. Current mirrors having higher output impedances have been designed (such as the "Wilson" mirror circuit of FIG. 2 and the "cascode" current mirror circuit), but the increased output impedance has been achieved in these circuits at the expense of a reduction in output voltage compliance. That is, the output voltage of the Wilson and cascode mirror designs is confined to a smaller range than for the simple current mirror (as a percentage of supply voltage), and that output cannot approach the supply voltage as closely as can the output of the basic current mirror. Consequently, to achieve a similar output voltage swing the cascode and Wilson mirror circuits require a greater supply voltage than does the basic mirror circuit. The extra voltage drop added by the second transistor in the output circuit is particularly troublesome in MOS mirror circuits. The voltage drop across each transistor is large in such circuits, compared to comparable bipolar transistor circuits, and doubling it severely reduces the compliance of the output.

Accordingly, it is an object of the present invention to provide an improved current mirror circuit having higher output impedance than the basic two-transistor current mirror circuit.

Another object of the invention is to provide an improved current mirror circuit having, in addition to higher output impedance than a basic current mirror, greater output voltage compliance than that of a cascode or Wilson-type current mirror.

SUMMARY OF THE INVENTION

The foregoing and other objects and advantages of the present invention are achieved in a circuit which employs a pair of MOS transistors operating at equal gate and sources voltages, and nearly equal drain voltages, to produce an accurately ratioed current mirror. The gate voltage of the transistor pair is controlled by a simple current mirror operating at a small fraction of the total output. The circuit also functions as a wide-band negative impedance converter.

An exemplary, but not limiting, implementation of the invention is set forth in the detailed description below, which should be read in conjunction with the accompanying drawing.

DETAILED DESCRIPTION

Figure 1:
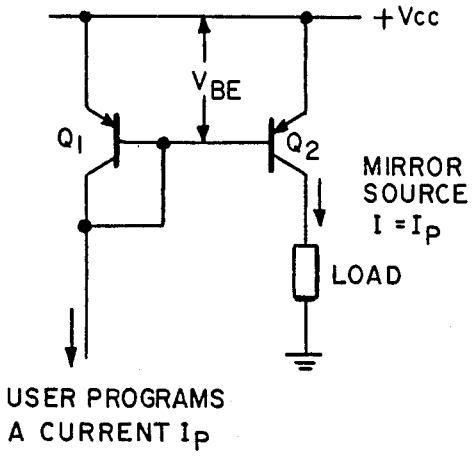
FIG. 1 PRIOR ART
FIG. 1 is a schematic circuit diagram of a basic two-transistor current mirror well known in the prior art.
Figure 2:
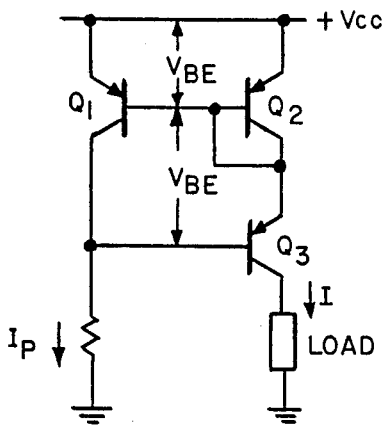
FIG. 2 PRIOR ART
FIG. 2 is a schematic circuit diagram of a representative prior art Wilson-type current mirror circuit.
Figure 3:
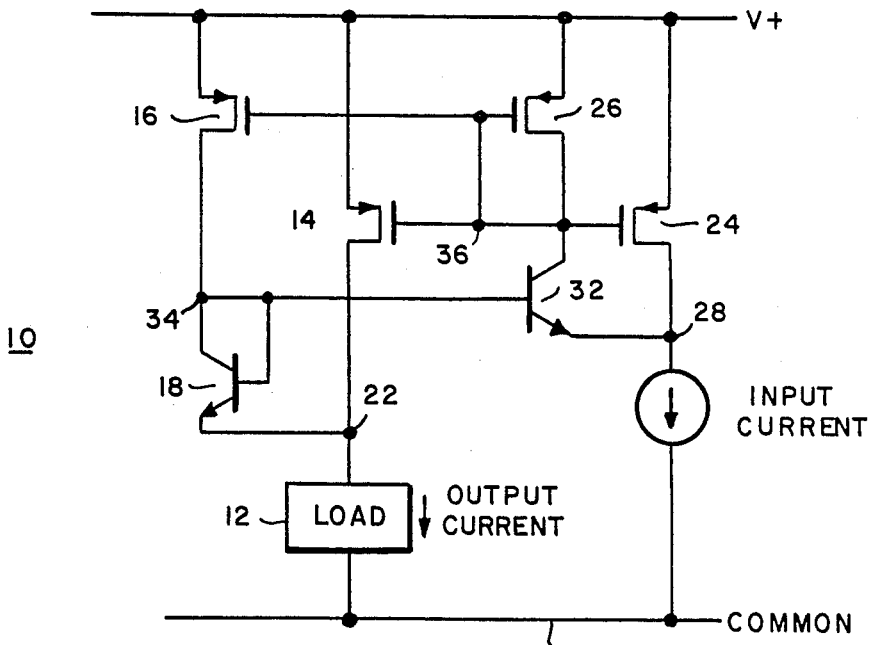
FIG. 3 is a schematic circuit diagram of an exemplary embodiment of a current mirror according to the present invention.

FIG. 3 illustrates an exemplary implementation of a high-compliance, high-output-impedance current mirror 10 according to the present invention. The main component of the output current into load 12 is provided from the drain of FET 14, and a small supplementary current is provided from FET 16 via diode-connected NPN bipolar transistor 18. The emitter current from transistor 18 adds to the drain current from transistor 14 at output node 22. FETs 24 and 26 sink the input current, which is connected at node 28. FETs 24 and 26 are matched, respectively, to FETs 14 and 16. The drain current from FET 26 is essentially transferred via bipolar NPN transistor 32 to input node 28, with the addition of base current from transistor 32.

Any current into the node 34 from transistor 16 will bias node 34 to some which is negative with respect to $V_+$, the source voltage. Input current drives input node 28 negative until the base-emitter junction of transistor 32 becomes forward biased. The resulting collector current in transistor 32 draws node 36 negative, increasing the drive to transistor 24. FET 24 will absorb more of the input current, and an equilibrium will be reached when transistor 24 takes all of the input current except for the current which transistor 26 sinks as a result of node 36 being driven and except for the base current of transistor 32.

The voltage at the gate of transistor 14 is the same as that at the gate of transistor 24, and their sources are at the same voltage, as well. Thus, transistor 14 will deliver about the same current to the load as transistor 24 must sink from the input node 28. At the same time, the current diverted from the input node to node 36, which is loaded by transistor 26, will be mirrored by transistor 16 and delivered to the load. This component of load current flows in transistor 18 and develops bias for the base of transistor 32. Since the currents in transistors 18 and 32 are nearly equal, the voltage at node 28 will be almost the same at node 22. This voltage will be responsive to changes in the load or input current to keep the drain voltage of transistor 24 very nearly equal to that of transistor 14. Therefore, the source, gate and drain voltages of FETs 24 and 14 remain equal as the circuit's output complies with the load requirements. This ensures that the load current supplied by transistor 14 accurately tracks the input current which transistor 24 sinks, limited only by the matching of the two devices.

The other major component of load current is supplied by transistor 16, which (as stated above) forms a simple current mirror with transistor 26 for a portion of the input current. This simple current mirror ensures there is a finite load at the common gates of transistors 14 and 24; this point must be loaded to carry off the current delivered by transistor 32. The load circuit modulates the current in transistors 32 in accordance with modulation of the voltage at node 36. Without the load, node 36 would be driven negative and then it would simply hold, or drift negative if transistor 32 has a small leakage.

The simple current mirror of transistors 26 and 16 need contribute, and does contribute, only a small amount to the total output current. Generally, transistors 16 and 26 are much smaller than transistors 14 and 24 and deliver only a small fraction of the total output. The effective output impedance of transistor 14 is very high, so the total output impedance of the mirror is essentially dictated by that of transistor 16. If FET 16 carries five percent of the total current, the output impedance of the entire mirror is about 20 times higher than a simple mirror handling the entire current. Another small error is contributed by the base current of transistor 32, which is not mirrored and subtracts from the drain current of FET 16. The error produced by this current is opposite in sign to the error produced by the output impedance of transistor 16. As a result, the net error must be smaller than either of the two errors taken separately.

The circuit 10 exhibits compliance to within (i.e., can swing as close to the supply voltage as) the gate-source voltage $V_{GS}$) of transistor 24 plus the collector-emitter saturation voltage of transistor 32 with respect to the supply voltage $V_+$. This is considerably better than the $2\ V_{GS}$ compliance limit required by the prior art Wilson and cascode mirrors, and the like.

The "off" state of the mirror 10 is stable, so a non-zero current must be ensured in order to start the mirror in an "on" condition. For example, one or more diodes (not shown) may be connected to prevent node 34 from going more negative than the compliance range of the input current supply, thus ensuring that some current will flow in transistor 32 and start the circuit. If the normal load voltage is higher than the clamp voltage, the starting diodes will be back-biased and disconnect once the circuit is on. Other starting arrangements can be used (and will readily occur to those skilled in the art), depending on the circuitry with which the mirror is employed.

Mirror circuit 10 is a negative impedance converter. Since the output voltage is forced onto the input terminal through the base-emitter junction of transistor 32 and the input current appears at the output terminal, the output impedance is, roughly, the negative of the input source impedance. This can be an additional useful function of the circuit, but it can also be a problem if the load impedance exceeds the input source impedance. Generally, the mirror circuit would be driven by a current source having a high source impedance; if the input capacitance is high, however, the net impedance at the output may become negative at high frequencies. To avoid frequency stability problems, the load capacitance must be made higher than the input capacitance.

Mirror circuit 10 can be used not only to supply an output current equal to the input current, but also to scale currents up or down from input to output. To accomplish this scaling, the width of transistor 14 must be adjusted so that it is different from that of transistor 24, with transistors 16 and 26 being adjusted to the same ratio. As a practical matter, this scaling can be done most accurately by using different numbers of identically made smaller devices to make up FETs 14 and 24, as well as 16 and 26. In this case, transistors 16 and 26 can be made similar to transistors 14 and 24, respectively, but with fewer sections.

Additional output transistors can be driven from node 36. This will work well when several loads must be driven to about the same potential as node 22.

Bipolar devices have been used for transistors 32 and 18, but complementary MOS transistors could be used in their stead. This would reduce the compliance somewhat; the resulting circuit would nevertheless have better compliance than the cascode or Wilson style current mirrors.

Naturally, all device polarities can be reversed to make a current mirror operable from a negative source voltage, $V_-$.

Having thus described an illustrative embodiment of the present invention, various alterations and improvements will readily occur to those skilled in the art. Such alterations and improvements are intended to be suggested by this disclosure. Accordingly, the foregoing detailed description is illustrative only and not limiting. The invention is limited only as defined by the following claims and equivalents thereto:

What is claimed is:

1. A current mirror circuit for receiving a source current at an input node and supplying at an output node, to a load, an output current which is a predetermined multiple of the source current, comprising:

a. first and second MOS transistors, the gates of such transistors being connected together, and the sources of such transistors being connected together and being connectable to a supply voltage;

b. the drain of the first transistor being connected to the input node;

c. the second electrode of the second transistor being connected to the output node; and d. means connected at the output node for sensing the voltage at said node, and capable of causing voltage at the input node to be substantially equal to the voltage sensed at the output node.

2. The current mirror of claim 1 wherein the output impedance at the output node is substantially equal to the negative of the source impedance connected at the input node.

3. The current mirror circuit of claim 1 wherein the means for causing the voltage at the input node to be substantially equal to the voltage at the output node comprises a transistor having a first electrode connected to the input node, a second electrode connected to the gates of the first and second MOS transistors, and a third electrode connected to receive a voltage substantially equal to the voltage at the output node.

4. The current mirror circuit of claim 3 further comprising a diode having a first electrode connected to the output node and a second electrode connected to the third electrode of the third transistor.

5. A current mirror circuit for receiving a source current at an input node and supplying at an output node, to a load, an output current which is a predetermined multiple of the source current, comprising:

a. first and second MOS transistors, the gates of such transistors being connected together, and the sources of such transistors being connected together and being connectable to a supply voltage;

b. the drain of the first MOS transistor being connected to the input node;

c. the drain of the second MOS transistor being connected to the output node; and d. third and fourth MOS transistors, the gates of such transistors being connected together and to the gates of the first and second MOS transistors, and the sources of such transistors being connected together and being connectable to said supply voltage, the drain of the third MOS transistor also being connected to its gate;

e. a first bipolar transistor, the base of which is connected to the drain of the fourth MOS transisor, the emitter of which is connected to the input node and the collector of which is connected to the gates of the first and second MOS transistors; and f. a diode having a first electrode connected to the drain of the fourth MOS transistor and a second electrode connected to the output node.

6. The circuit of claim 5 wherein the diode is a diode-connected bipolar transistor.

7. A current mirror circuit for receiving a source current at an input node and supplying at an output node, to a load, an output current which is a predetermined multiple of the source current, comprising:

a. first and second transistors, each having first and second electrodes and a control electrode to which a signal may be applied to control current in the first and second electrodes, the control electrodes of the first and second transistors being connected together, and the first electrodes of such transistors being connected together and being connectable to a supply voltage;

b. The second electrode of the first transistor being connected to the input node;

c. the second electrode of the second transistor being connected to the output node; and d. means connected at the output node for sensing the voltage at said node, and capable of causing voltage at the input node to be substantially equal to the voltage sensed at the output node.

8. The current mirror of claim 7 wherein the output impedance at the output node is substantially equal to the negative of the source impedance connected at the input node.

9. The current mirror circuit of claim 7 wherein the means for causing the voltage at the input node to be substantially equal to the voltage at the output node comprises a transistor having a first electrode connected to the input node, a second electrode connected to the control electrodes of the first and second transistors, and a third electrode connected to receive a voltage substantially equal to the voltage at the output node.

10. The current mirror circuit of claim 9 further comprising a diode having a first electrode connected to the output node and a second electrode connected to the third electrode of the third transistor.

11. A current mirror circuit for receiving a source current at an input node and supplying at an output node, to a load, an output current which is a predetermined multiple of the source current, comprising:

a. first and second MOS transistors, the gates of such transistors being connected together, and the sources of such transistors being connected together and being connectable to a supply voltage;

b. the drain of the first MOS transistor being connected to the input node;

c. the drain of the second MOS transistor being connected to the output node; and d. third and fourth MOS transistors, the gates of such transistors being connected together and to the gates of the first and second MOS transistors, and the sources of such transistors being connected together and being connectable to said supply voltage, the drain of the third MOS transistor also being connected to its gate; and e. a bipolar transistor, the base of which is connected to the drain of the fourth MOS transistor, the emitter of which is connected to the input node and the collector of which is connected to the gates of the second MOS transistor.

* * * * *